United States Patent [19]

Steiner

[11] 4,316,370

[45] Feb. 23, 1982

[54] YARN CONDITIONING PLANT

[75] Inventor: Erwin Steiner, Clover, S.C.

[73] Assignee: American Sussen Corp., Charlotte, N.C.

[21] Appl. No.: 145,010

[22] Filed: Apr. 29, 1980

[51] Int. Cl.[3] ..... B65H 59/38

[52] U.S. Cl. ..... 68/5 D; 28/281; 242/45; 242/47.13

[58] Field of Search ..... 68/5 D, 5 E; 242/35.5 R, 45, 47.13; 28/281

[56] References Cited

U.S. PATENT DOCUMENTS

| | | | |
|---|---|---|---|
| 2,276,394 | 3/1942 | Hill et al. | 68/5 D X |
| 3,350,022 | 10/1967 | Bense | 242/45 |
| 3,774,384 | 11/1973 | Richter | 68/5 D X |
| 3,972,176 | 8/1976 | Lawson, Jr. et al. | 28/281 X |
| 4,234,133 | 11/1980 | Enneking | 242/45 |

FOREIGN PATENT DOCUMENTS

| | | | |
|---|---|---|---|
| 46-40515 | 11/1971 | Japan | 28/281 |

*Primary Examiner*—Philip R. Coe

*Attorney, Agent, or Firm*—Craig and Antonelli

[57] ABSTRACT

A yarn conditioning plant for processing of yarn at high temperature is improved by provision of arrangements for enabling a plurality of yarn threads that have simultaneously been processed upon a single yarn transport to be wound individually upon separate spools. In accordance with a first preferred embodiment, a tension balancing means is provided which includes a potentiometer that is acted upon by the thread tension of yarn threads passing thereover so as to control the operating speed of individually driven spools. According to a further embodiment, the tension of the individual yarn threads is compensated by the use of two separate storage devices upon which the individual processed yarns can be separately wound in a manner so as to achieve a uniform tensioning thereof.

9 Claims, 9 Drawing Figures

YARN CONDITIONING PLANT

BACKGROUND AND SUMMARY OF THE INVENTION

The invention relates to a yarn conditioning plant for continuous processing of yarn, said yarn being drawn from a yarn supply, guided through a yarn processing chamber by a transport means, and then being wound on a spool.

The purpose of yarn conditioning plants is to condition yarn with the thread running continuously from spool to spool. This eliminates the need to make up the yarn into skeins for conditioning purposes, and then rewind the yarn. Therefore, the yarn conditioning plant is capable of performing various types of conditioning such as heat-setting unwrinkling, shrinking, texturing, steaming, drying, postforming or wet-treating various yarns in a continuous process. In addition, depending on the equipment in the yarn conditioning plant, several conditioning processes can be performed during a single pass.

According to one prior art conditioning plant (Hoerauf-Suessen GVA Yarn Conditioning Plant, Hoerauf Suessen Technical Information 6.3-00100E 9.75), in each of six working positions a mast carries four conveyor belts which extend through the yarn processing chamber. One or more yarn threads are continuously wound about the array of conveyors at one end, conveyed through the processing chamber to a temporary storage device formed at the other end of the conveyors, and then removed from the temporary storage device by a spooler, all as part of a continuous process.

Up until now this type yarn conditioning plant has been utilized with spoolers having only a single bobbin winder for each working position, i.e. whether one or multiple threads, simultaneously, were processed at a given working position, only a one single or multiple thread yarn was produced, as opposed to separation and individual winding of multiple threads that are simultaneously processed.

While it would be advantageous to be able to simultaneously process and separately wind a plurality of yarn threads in any one or more working stations, such has not been practical for several reasons. Firstly, prior art apparatus encounter problems with regard to separation of the yarn threads after processing, and furthermore, multi-thread systems would, at best, only allow the winding of so-called "cylindrical cheeses" (as opposed to cones ready for sale) which means an additional winding operation if cones are required.

It is believed that the above problems are directly related to the fact that the yarn threads undergo shrinkage during processing, which affects the length, bulk, and tension of the yarn. This problem is particularly acute with heat treatment processing for bulking carpet yarns which can cause up to an approximately 27% shortening of a processed yarn relative to its previous unprocessed condition. Since each yarn thread will not undergo the exact same changes, if a plurality of yarn threads are simultaneously processed on a common conveyor, even if only a 2% difference in shrinkage occurs, if a common drive is used to wind the finished yarn threads they will be under tensions which are different enough to result in one yarn thread being wound tight and the other loose in comparison. Such a difference in yarn tension is a problem since an optical streak will be present in a carpet that is then produced from such simultaneously processed yarns.

Accordingly, it is an object of the present invention to enable simultaneous processing of multiple yarn threads on single conveyance arrangements and separate winding of the individual yarns thereafter.

It is a further object of the present invention to provide an arrangement for compensating for differences in shrinkage so as to enable plural simultaneously processed yarn threads to be wound under substantially uniform tension.

These objects are achieved in accordance with a first preferred embodiment of the invention by providing an arrangement which detects the existence of a greater tension on one of the two processed yarn threads and effectuates a change of winding speed so as to equalize the winding tension on the yarn threads. In this first embodiment, a rocker-arm potentiometer produces a tension-differential proportional signal that produces the required winding speed adjustment.

Similarly, in a further embodiment independent temporary devices are provided for use with each of the separate yarn threads. The separate temporary storage devices enable the yarn threads to be placed in a condition of uniform tension and thus can be uniformly spooled by separate winding mechanisms.

These and further objects, features and advantages of the present invention will become more obvious from the following description when taken in connection with the accompanying drawing which shows, for purposes of illustration only, several embodiments in accordance with the present invention.

DETAILED DESCRIPTION OF THE PREFERRED EMBODIMENTS

Figure 1:
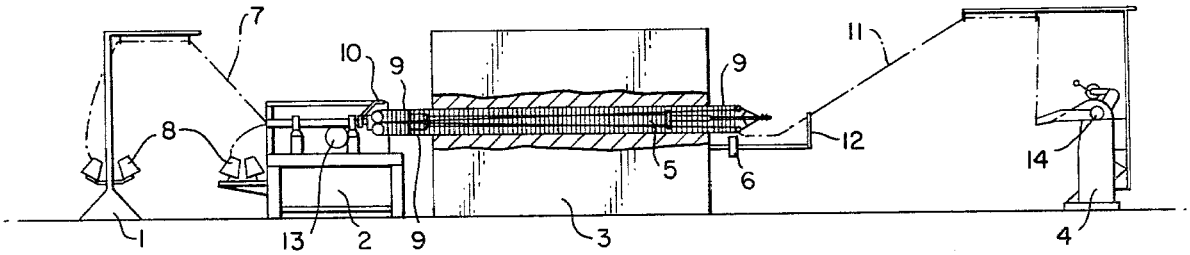
FIG. 1 is a side view of an entire yarn conditioning plant in accordance with the present invention.
Figure 2:
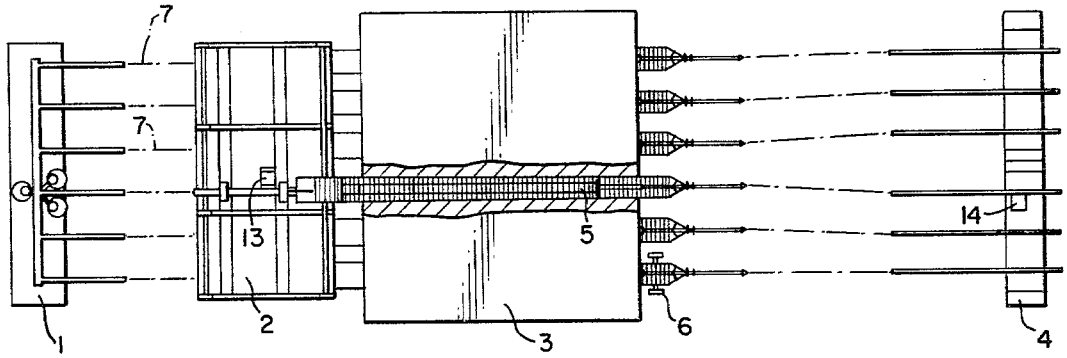
FIG. 2 is a top view of the plant shown in FIG. 1.

FIGS. 1 and 2 show a yarn conditioning plant, with FIG. 1 being a side view and FIG. 2 being a top view of the plant. The plant consists essentially of the following parts:

A yarn supply device 1 for holding the yarn 7 in readiness, for example, a frame for supply bobbins 8, a winding machine 2 to wind the yarn 7 to be processed on conveyor belts 9, a processing chamber 3 and a spooler 4. Masts 5 (only one of the six of which is shown in a partial break-away section of FIG. 2) starting at winding machine 2, are guided through processing chamber 3, said masts projecting from the end of processing chamber 3 a slight distance in the direction of spooler 4 and guiding conveyor belts 9. Devices for storing the yarn (see below with reference to FIG. 1*a*) not shown in FIGS. 1 and 2, are mounted on those parts of masts 5 which project from processing chamber 3; these storage devices are monitored by photocells 6, whereby the drive of spooler 4 is controlled as a function of its fullness.

Threads 7 are drawn from frame 8 by a respective winding arm 10 on winding machine 2 associated with each of the six masts. Then threads 7 are guided in winding machine 2 through hollow shafts not shown in FIGS. 1 and 2 to winding arm 10 (see FIG. 1*a*). Winding arm 10 rotates about mast 5 thereby winding thread 7 around conveyor belts 9, said belts being disposed along the length of mast 5. Conveyor belts 9 then transport to yarn 7, now wound in layers around conveyor belts 9 (see FIG. 1*a*) into processing chamber 3, where the yarn is processed by being exposed to the action of a processing medium, for example steam, under the influence of temperature. The residence time of yarn 7 in processing chamber 3 can be determined by the speed of conveyor belts 9, said belts moving continuously through processing chamber 3. Conveyor belts 9 and winding machine 2 are driven by motor 13 while spooler 4 is driven by motor 14.

When conveyor belts 9 have moved processed yarn 11 out of processing chamber 3, the yarn is retained for a period of time on the storage device of mast 5, not shown in FIGS. 1 and 2. Spooler 4 then pulls yarn 11 off the storage device. Yarn 11, however, is pulled off more slowly than it is supplied to the storage device. As soon as the storage device reaches a certain degree of fullness, the speed of spooler 4 is increased briefly at a signal from photocell 6.

In order to keep the quality of the yarn after conditioning always constant, the measures described hereinbelow are employed, and are intended to keep the processing temperatures and yarn tensions as uniform as possible.

Figure 1A:
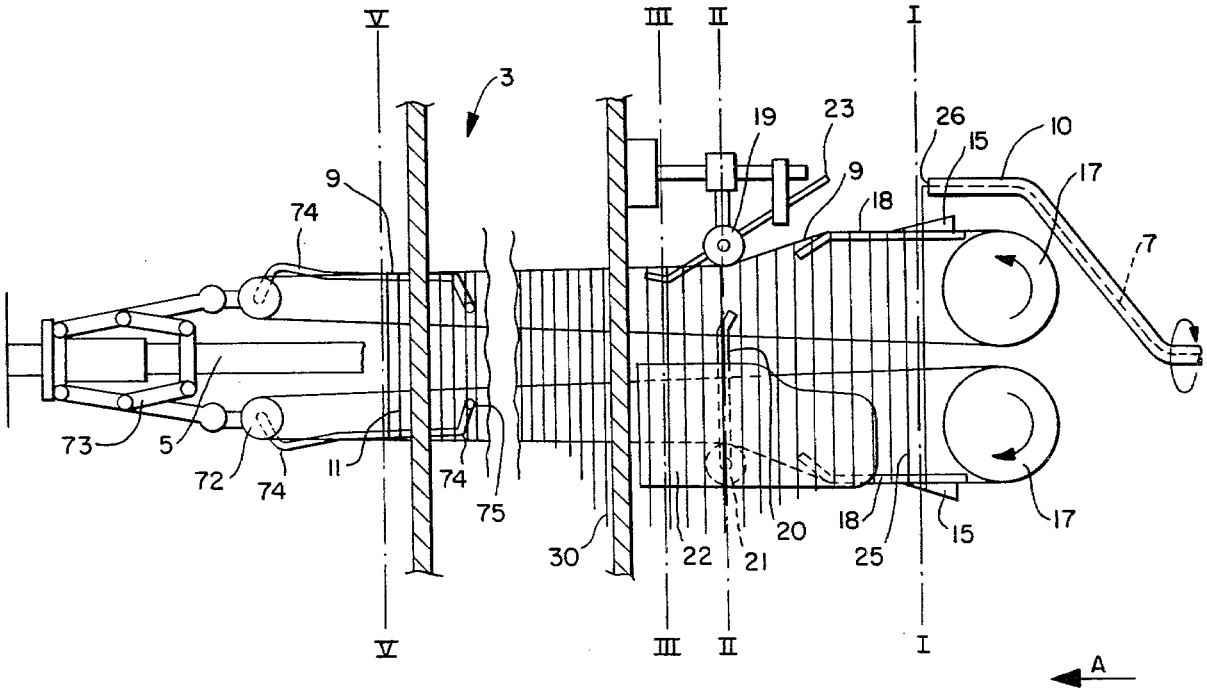
FIG. 1*a* is a partial section side view of entry and exit ends of the processing zone of the plant shown in FIG. 1.

In order to keep the tension of yarn 7 low as it is wound around conveyor belts 9 by winding arm 10, suitable devices are shown in FIG. 1*a*. It should be noted that the yarn is shown in FIG. 1*a* as passing through the system from right to left. FIG. 1*a* shows the entire yarn transport system with winding mast 5, drive belts 9, and further associated devices.

It is apparent from FIGS. 1 and 1*a* that thread 7 is guided by winding arm 10, said arm describing a circular movement around mast 5 thus laying down thread 7 on conveyor belts 9. Yarn 7 is laid down in such fashion that it is wound around the four conveyor belts 9 (only two of which are shown in FIG. 1*a*) and two associated sliding surfaces 15 which serve to equalize the tension of yarn 7 on conveyor belts 9, are adjustable in the direction of travel A of yarn 7 relative to aperture 26, are horizontal, inclined at an angle of approximately 30° to the axis of mast 5, mounted between conveyor belts 9, and are also slightly convex. The yarn is carried suspended in an air current so that depositing of the yarn in layers 25 is not under high tension as would be the case if yarn threads were pulled from the winding arm by the conveyor 59, so that the yarn layers 25 slide off sliding surfaces 15 and are laid down uniformly on conveyor belts 9.

Conveyor belts 9, driven by rollers 17 are so supported and guided in runners 18 that the yarn layers do not come in contact with runners 18 as they are conveyed in the direction of processing chamber 3. As soon as the yarn layers have left sliding surface 15 and are supported by the conveyor belts 9 alone, yarn 7 is under zero tension. The circumference of the yarn layers is equal to the circumference determined by the arrangement of conveyor belts 9. This method of laying down the yarn 7, in addition to offering the advantage of uniformity of laying down and equalization of tension in the laid-down yarn 7, also has the effect of protecting conveyor belts 9.

The conveyor belts 9 carry the yarn through processing chamber 3 where it is conditioned with steam and heat which cause the yarn to be shrunk, crimped, bulked or the like as appropriate to its intended use. After conditioning, yarn 11 (see FIG. 1) is transported out of processing chamber 3.

As FIG. 1*a* indicates, the conditioned yarn 11 is transported out of processing chamber 3 on the four conveyor belts 9 which are guided over four rollers 72 at the end of mast 5. Rollers 72 can be displaced by means of a belt adjustment device 73 mounted on mast 5, said device functioning according to the known umbrella principle, in a vertical and horizontal direction relative to mast 5, whereby it is advantageous to adjust the settings of the individual positions of rollers 19 and 20.

Storage basket slats 74 are mounted on the axles of rollers 72, said slats being adjustable by belt-adjusting device 73, together with rollers 72. Storage basket slats 74, beginning at rollers 72, run inside the yarn layers in the direction of processing chamber 3 and are rotatably mounted at points 75 with respect to mast 5. They are arranged parallel to conveyor belts 9 for a large part of their overall length; however, they are displaced slightly outward with respect to the lengthwise direction of conveyor belts 9. In the vicinity of rollers 72, storage basket slats 74 are bent slightly outward relative to their otherwise parallel-displaced path. The parallel-displaced arrangement and the curvature of the storage basket slats 74 ensure that the yarn layers accumulate at the end of mast 5.

The spooler 4 shown in FIG. 1 pulls the yarn continuously off the above-described storage device. Yarn 11 is pulled off more slowly than it is supplied to the storage device. As soon as the yarn layers on the storage device of mast 5 have been displaced up to the level of photocell 6, the speed of spooler 4 is increased briefly in response to a signal from photocell 6; yarn 11, which has accumulated up to the photocell, is then pulled off slightly more rapidly than it is supplied to the storage device. After a short time, the speed of spooler 4 decreases again. Spooler 4 then continues running at reduced speed until the storage device has again filled up to photocell 6, and the signal from photocell 6 increases the speed of spooler 4 once more. In this manner, yarn 11 can be spooled continuously.

To the extent described so far, the yarn conditioning plant in accordance with the present invention corresponds to the Hoerauf-Suessen GVA yarn conditioning plant described above, which in the past was utilized with one or more incoming yarn threads 7 for each mast unit and a single spool spooler 4, multiple incoming yarn threads being taken up and spooled as single multi-thread yarn.

In accordance with the following features of the present invention the above-described yarn conditioning plant has been modified to permit problem-free conditioning of two threads 7, simultaneously, on one mast 5 after which they are separated and spooled separately. In this case, yarn threads 7 are wound by winding arm 10 in two threads in parallel around conveyor belts 9. Conveyor belts 9 carry the yarn layers through processing chamber 3 up to the storage device, where the two threads are accumulated in parallel layers.

It is noted that, while the winding of the yarn threads by winder 10 will produce some winding or twisting together, this poses no problem with regard to separate spooling thereof since this twisting is limited to one twist per meter of yarn and is easily removed by the application of a reverse twist by unwinding arm 12 which rotates in a direction opposite to that of winder 10.

In the case of conditioning of two threads simultaneously on one mast 5, special devices are required which pull off yarn 11 separately from the storage devices on mast 5 and spool them on separate spools, of the same length if possible.

Figure 3:
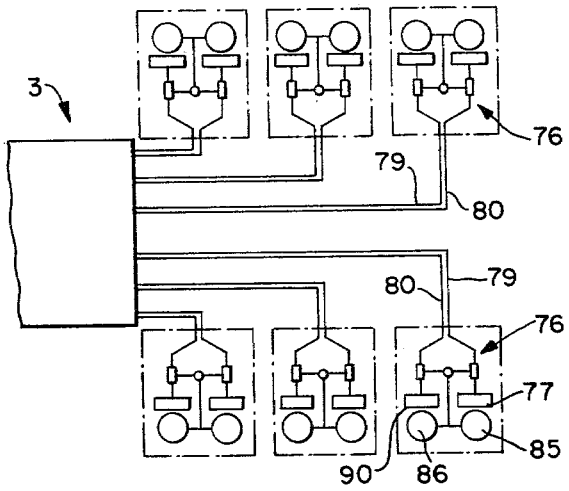
FIG. 3 is a winding device with six spoolers for two-thread spooling, with a rocker-operated potentiometer.
Figure 4:
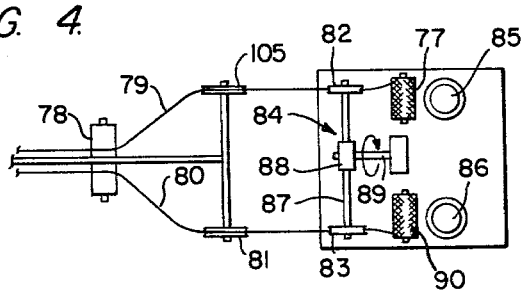
FIG. 4 is a top view of the spooler in FIG. 3.

Such a device is shown in FIG. 3, where two threads 79 and 80 on masts 5, not shown in FIG. 1*a*, emerge from processing chamber 3, and are wound upon spools 77 and 90 by spoolers 76, represented schematically by dot-dashed lines in FIG. 3. Spool 77 is driven by motor 85 and spool 90 is driven by motor 86. FIG. 4 is a top view and FIG. 5 is a side view of such a spooler 76.

Figure 5:
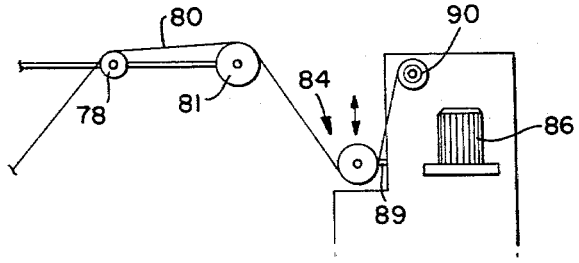
FIG. 5 is a side view of the spooler shown in FIG. 4.
Figure 6:
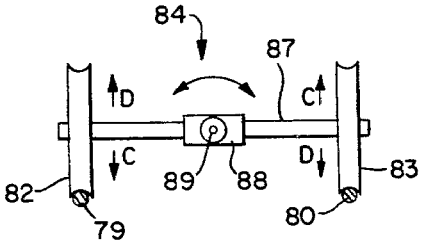
FIG. 6 is a detailed view of the rocker-operated potentiometer shown in FIGS. 4 and 5.

It is apparent from FIGS. 4 and 5 that after the yarn has been unwound from the storage device on the mast, the yarn is guided in the form of two parallel threads 79 and 80 over a roller 78 beyond which the two threads separate. The individual threads 79 and 80 then are guided separately over rollers 105 and 81 and rollers 82 and 83 mounted on rocker-operated potentiometer 84, and are finally wound on spools 77 and 90 driven by motors 85 and 86. Motors 85 and 86 operate in synchronization; the speed of the two motors 85 and 86 and therefore the spooling speed of spools 77 and 90 increases when the yarn layers on the storage device are displaced up to the height of photocell 6, and trigger a signal from the photocell 6 shown in FIGS. 1 and 2. This signal produces a brief acceleration of the two motors 85 and 86 so that the storage device is partially emptied. After a short time, the speed of the two motors 85 and 86 slows down again, so that the storage device again fills up to photocell 6 and triggers the signal to increase the speed. The average spooling speeds of the two spools 77 and 90 are equal. At the same time, the speed control accomplished by photocells 6 is backed up by rocker-operated potentiometer 84, shown in a front view in FIG. 6, and which will be described in greater detail hereinbelow.

Rocker-operated potentiometer 84 consists essentially of the two rollers 82 and 83 which travel around axle 87, and potentiometer 88. Axle 87 is mounted swivellably about a fixed axis 89. Potentiometer 88 reacts to the rotation of rocker-operated potentiometer 84 about axis 89 and controls the speed of motors 85 and 86 depending on the magnitude of the inclination of the axis.

Since threads 79 and 80 do not always shrink equally during processing in a processing chamber 3, threads 79 and 80 may have unequal tensions when they emerge from processing chamber 3. If the speeds of motors 85 and 86, regulated by photocells 6 alone, are of equal speed there is the danger that with different tensions on threads 79 and 80, spooling would produce spools of different firmnesses. This is a particular problem when processing carpet yarns where shrinkage can be on the order of 27% with a 2% difference in shrinkage occurring between threads producing significant problems if not compensated for, as previously noted. Rocker-operated potentiometer 84 permits compensation for different thread tensions, and the speeds of motors 85 and 86 may also be regulated individually. However, this additional regulation is minor by comparison with the control which is exercised by photocell 6. For example, if thread 80 has a greater tension than thread 79 as it runs over roller 83, potentiometer 84 will be rotated about axis 89 in the direction of arrow C. Potentiometer 88, reacting to its rotation, delivers a pulse to motor 85 so that the speed of motor 85, driving spool 77, is increased. Then thread 79 will be spooled more rapidly and will receive a higher thread tension as a result. The higher thread tension on roller 82 will then cause potentiometer 84 to rotate in the direction of arrow D. The pulse from potentiometer 88 which then reacts will again reduce the speed of motor 85. The same is true of the case in which the tension on thread 79 on roller 82 is greater than the tension of thread 80 on roller 83.

With the aid of potentiometer 84, uniform yarn tension on the spools can be maintained even when conditioning two threads 79 and 80 on one mast 5.

Figure 7:
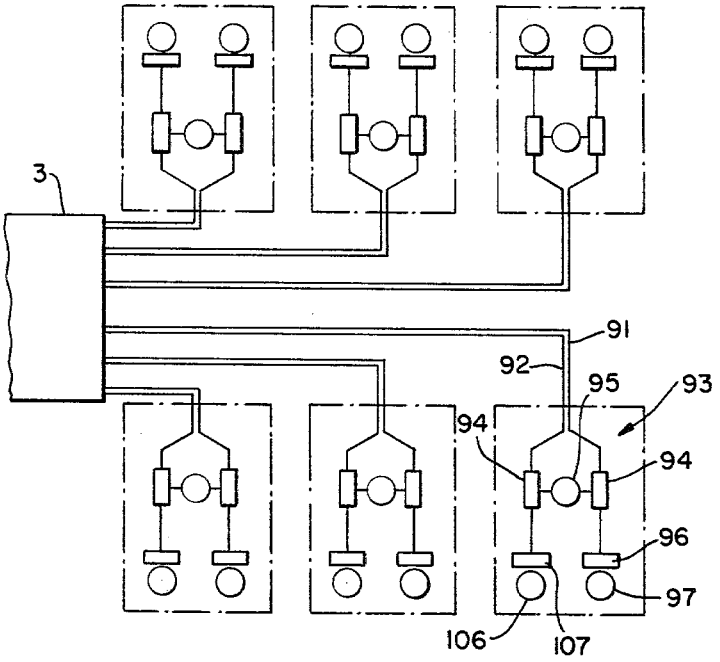
FIG. 7 is another spooling device with six spoolers for two-threading spooling with storage devices.

Another design for the spooler for use with two-thread conditioning is shown in FIG. 7. As in FIG. 1*a*, in this embodiment as well, six masts, not shown in FIG. 7, emerge, each carrying two threads 91 and 92. Threads 91 and 92 are guided to spoolers 93, indicated schematically in FIG. 7 by dot-dashed lines. Each of the spoolers 93 has two separate storage devices 94, said devices being driven synchronously by a motor 95. The speed of motor 95 depends upon the point to which the storage device of mast 5 (FIG. 1*a*) is filled. It is controlled in the same fashion as the speed of the above-mentioned spooler 4. Accordingly, here again the speed of motor 95 is increased briefly by a signal from photocell 6, shown in FIGS. 1 and 2, when the storage device is full.

Figure 8:
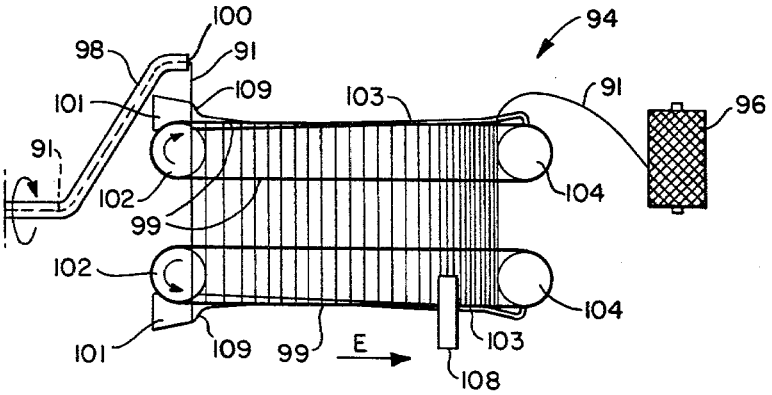
FIG. 8 is a side view of the storage device in FIG. 7.

Storage device 94 is shown in a side view in FIG. 8. Two spools 96 and 107 are associated with each of these storage devices 94, said spools being driven by motors 97 and 106, whereby motors 97 and 106 associated with one spooler 93 operate independently of one another.

As is evident from FIG. 7, threads 91 and 92 of spooler 93 are guided in parallel, to the point where they are separated from one another before they reach storage devices 94. Storage devices 94 shown in FIG. 8 correspond in design in part to the yarn transport device shown in FIG. 1*a*. The winding arm 98 of storage device 94 describes a circular motion about the four conveyor belts 99 (only two of which are shown). Here the thread 91, guided through winding arm 98 and emerging at opening 100, is wound around conveyor belts 99 and sliding panels 101, said panels being mounted between the conveyor belts 99 and being adjustable lengthwise with respect to the latter. Thread 91 is sloughed off immediately after being wound around sliding panel 101 at its edge 109 and is transported by conveyor belts 99, driven by rollers 102, in the direction of arrow E. This type of wrapping ensures that thread 91 (and similarly thread 92) is separately and uniformly laid down, and the tension in the laid-down yarn is compensated.

Storage basket slats 103 are located on the upper and lower sides of storage device 94, in a longitudinal direction between conveyor belts 99. Storage basket slats 103 run primarily parallel to conveyor belts 99, but are displaced slightly outward relative to the lengthwise surface of conveyor belts 99. In the vicinity of rollers 104, storage basket slats 103 are curved slightly outward. Storage basket slats 103 ensure that the yarn layers, transported by conveyor belts 99 in the direction of arrow E, will accumulate at the end of storage device 94, in a manner similar to slats 74 in FIG. 1*a*. Thread 91 is then wound up with the aid of motor 97 on spool 96 (FIG. 8). The same is true of thread 92. The speed of motor 97 is controlled in accordance with the same principle as the above-described speed control for spooler 4. Thread 91 is pulled off by motor 97 somewhat more slowly from the storage device 94 than it is fed to the latter by winding arm 98. As soon as storage device 94 has been filled up to a certain point, the speed of motor 97 is briefly increased in response to a signal from photocell 108.

The embodiment of FIG. 7 with two storage devices 94 for each spooler 93 has the advantage relative to that of FIG. 3 in that even when working with two threads, automatic spool changers can be used because the thread 91 can accumulate in the storage device 94 while the associated one of the spools is being changed.

While I have shown and described various embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Yarn conditioning plant comprising:

(a) yarn supply means for holding a supply of yarn;

(b) yarn conditioning chamber means for processing yarn at high temperature;

(c) at least one yarn transport means for conveying yarn received from said yarn supply means through said yarn conditioning chamber means;

(d) first transfer means associated with each of said transport means for removing a plurality of yarn threads from said yarn supply means and transferring the yarn threads to said associated yarn transport means;

(e) second transfer means for removing said plurality of yarn threads from said yarn transport means;

(f) spooler means for receiving said plurality of yarn threads from said second transfer means and for separately spooling each yarn thread; and (g) yarn tension balancing means for compensating for differences in tension between the tension of a first of said yarn threads and a second of said yarn threads, said yarn tension balancing means being positioned between said second transfer means and said spooler means, whereby a plurality of spools of uniform firmness are obtained.

2. Yarn conditioning plant according to claim 1, wherein said spooler means comprises a spooler associated with each yarn transport means, said spooler having at least two, individually driven spools, whereby two yarn threads can be processed upon a single yarn transport means and separately spooled.

3. Yarn conditioning plant according to claim 2, wherein said tension balancing means comprises a potentiometer means that is rotatable under the influence of the thread tension of yarn threads passing thereover for controlling the operating speed of said individually driven spools.

4. Yarn conditioning plant according to claim 3, wherein said potentiometer means is disposed on an axis of rotation of a double-armed lever and has rollers disposed at free ends of said lever and subject to the action of said thread tension.

5. Yarn conditioning plant according to claim 2, wherein the yarn tension balancing means comprise means for temporary separate storage of each of said yarn threads.

6. Yarn conditioning plant according to claim 5, wherein said yarn transport means includes a temporary yarn storage means and wherein the means for separate storage each comprise a common drive motor that is adjustable as a function of the fullness of said temporary storage means, said common drive motor being distinct from drive means associated with said spooler means.

7. Yarn conditioning plant according to claim 6, wherein the means for separate storage each comprise a photocell means for adjusting the drive motors of the spooler means.

8. Yarn conditioning plant according to claim 6 or 7, wherein said means for separate storage comprise a plurality of upper and lower conveyor belts, sliding panel means positioned between said upper conveyor belts at an upstream end thereof and extending from a position thereabove to a position thereunder for receiving a yarn thread from said second transfer means and storage slat means extending from a position between a downstream portion of said upper conveyor belts to a position therebeyond for temporarily retaining yarn thread layers thereon, and wherein said second transfer means comprises a winding arm means for winding said yarn thread about said conveyor belts.

9. Yarn conditioning plant according to claim 2 or 4 or 6, wherein said first transfer means comprises a winding arm, said winding arm being operable to execute circular movements about said yarn transport means, and wherein said yarn transport means comprise a plurality of upper and lower endless belts for yarn transport.

* * * * *